US012317957B2

(12) United States Patent
Case et al.

(10) Patent No.: US 12,317,957 B2
(45) Date of Patent: Jun. 3, 2025

(54) BLADDERS AND FOOTWEAR INCORPORATING BLADDERS IN THE FOOT SUPPORTS AND UPPERS

(71) Applicant: NIKE, Inc., Beaverton, OR (US)

(72) Inventors: Patrick R. Case, Portland, OR (US); Yoon Jeong Choi, Portland, OR (US); Dervin A. James, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 5 days.

(21) Appl. No.: 18/213,668

(22) Filed: Jun. 23, 2023

(65) Prior Publication Data

US 2023/0413949 A1 Dec. 28, 2023

Related U.S. Application Data

(60) Provisional application No. 63/355,843, filed on Jun. 27, 2022.

(51) Int. Cl.
*A43B 23/02* (2006.01)

(52) U.S. Cl.
CPC ..... *A43B 23/029* (2013.01); *A43B 23/0215* (2013.01)

(58) Field of Classification Search
CPC ..... A43B 23/029; A61F 5/012; A61H 9/0078
See application file for complete search history.

(56) References Cited

U.S. PATENT DOCUMENTS 2,981,010 A 4/1961 Aaskov
4,217,705 A 8/1980 Donzis
(Continued)

FOREIGN PATENT DOCUMENTS

CN 207400394 U 5/2018
CN 210248619 U 4/2020
(Continued)

OTHER PUBLICATIONS

Oct. 2, 2023 (WO) International Search Report and Written Opinion—App. PCT/US2023/026200, 11 pages.
(Continued)

*Primary Examiner* — Sharon M Prange
*Assistant Examiner* — Grady Alexander Nunnery
(74) *Attorney, Agent, or Firm* — Banner & Witcoff, Ltd.

(57) ABSTRACT

Bladders for footwear uppers, footwear components and articles of footwear including the bladders, and/or methods of making and using such bladders are described. The bladders may include first and second thermoplastic elastomer sheets joined together by an outer perimeter bond. An interior chamber is defined between the thermoplastic elastomer sheets and inside the outer perimeter bond. The outer perimeter bond may be shaped such that the interior chamber forms: (i) a foot support chamber portion for supporting at least a portion of a plantar surface of a wearer's foot, and at least one of items (ii) and (iii) below, in which: item (ii) comprises a first side chamber portion (e.g., forming at least part of a first securing strap or a first footwear upper component), and item (iii) comprises a second side chamber portion (e.g., forming at least part of a first strap-engaging member or a second footwear upper component).

10 Claims, 5 Drawing Sheets

(56) References Cited

U.S. PATENT DOCUMENTS

| | | | | |
|---|---|---|---|---|
| 5,443,440 | A * | 8/1995 | Tumey | A61H 9/0078 128/DIG. 20 |
| 5,451,201 | A * | 9/1995 | Prengler | A61F 5/012 602/26 |
| 5,784,807 | A | 7/1998 | Pagel | |
| 5,807,290 | A * | 9/1998 | Barry | A61F 5/012 5/734 |
| 5,846,063 | A * | 12/1998 | Lakic | A43B 17/035 36/43 |
| 5,868,690 | A * | 2/1999 | Eischen, Sr. | A61H 9/0078 128/DIG. 20 |
| 5,985,383 | A | 11/1999 | Allen et al. | |
| 6,001,119 | A * | 12/1999 | Hampson | A61H 9/0078 606/202 |
| 6,014,823 | A | 1/2000 | Akic | |
| 6,170,173 | B1 | 1/2001 | Caston | |
| 6,488,643 | B1 * | 12/2002 | Tumey | A61F 5/0111 601/150 |
| 7,478,488 | B1 | 1/2009 | Davis et al. | |
| 9,351,536 | B2 | 5/2016 | Schindler et al. | |
| 9,420,847 | B2 | 8/2016 | Elder et al. | |
| 9,468,252 | B2 | 10/2016 | Dimatteo | |
| D817,607 | S | 5/2018 | Morrison | |
| 9,974,361 | B2 | 5/2018 | Zeng | |
| 10,499,707 | B2 | 12/2019 | Hobson et al. | |
| 2004/0003515 | A1 | 1/2004 | Marvin et al. | |
| 2005/0048236 | A1 * | 3/2005 | Watkins | B32B 27/306 428/35.2 |
| 2005/0241185 | A1 | 11/2005 | Flood et al. | |
| 2007/0074427 | A1 * | 4/2007 | Ponsi | A61F 5/0111 36/110 |
| 2012/0253250 | A1 * | 10/2012 | Spahn | A61F 5/0127 602/13 |
| 2012/0316481 | A1 * | 12/2012 | Purdy | A61H 9/0078 601/151 |
| 2013/0085428 | A1 * | 4/2013 | Deshpande | A61H 9/0092 601/148 |
| 2013/0227857 | A1 | 9/2013 | Schindler et al. | |
| 2013/0283640 | A1 * | 10/2013 | Elder | A43B 3/128 36/102 |
| 2015/0059215 | A1 | 3/2015 | Burch | |
| 2017/0013915 | A1 | 1/2017 | Caston, Jr. | |
| 2018/0014963 | A1 * | 1/2018 | Griffiths | A61F 5/05816 |
| 2018/0110286 | A1 | 4/2018 | Vuong | |
| 2021/0112919 | A1 | 4/2021 | Marston | |
| 2021/0361030 | A1 | 11/2021 | Hopkins | |

FOREIGN PATENT DOCUMENTS

| | | | |
|---|---|---|---|
| KR | 0114451 | Y | 4/1998 |
| KR | 101098020 | B1 | 12/2011 |
| KR | 101116431 | B1 | 2/2012 |
| KR | 101627108 | B1 | 6/2016 |
| KR | 20170003566 | U | 10/2017 |

OTHER PUBLICATIONS

Sep. 28, 2023 (WO) International Search Report and Written Opinion—App PCT/US2023/026203, 11 pages.

Coady, Serena, "Amazon is selling freezer slippers and ohter unlikely body cooling items," metro.co.uk, Jul. 24, 2019, <<https://web.archive.org/web/20190922163415/https://www.amazon.co.uk/Pair-cold-foot-wrap-feet/dp/B00VKTO11Y Discloses slippers with gel that one can freeze or warm, 3 pages.

"Isla Air Slides," blastiful. com, Accessed: Dec. 6, 2021, <<https://web.archive.org/web/20211206231424/https:// blastiful.com/products/isla-eva-sofa-slides-women-thick-sole-soft-indoor-slippers-anti-slip-sandals-men-summer-platform-shoes-bath?variant=40513202815127, discloses slippers with air cushions, 4 pages.

"Comfort Gel Slippers," supportplus.com, Accessed: Dec. 6, 2021, <<https://web.archive.org/web/20211206233611/https://www.supportplus.com/FJ2592.html>>, discloses gel cushion slippers, 1 page.

* cited by examiner

BLADDERS AND FOOTWEAR INCORPORATING BLADDERS IN THE FOOT SUPPORTS AND UPPERS

FIELD OF THE INVENTION

The present invention relates to bladders and footwear incorporating such bladders in the foot supports and uppers and/or methods of making and using such bladders, foot supports, uppers, and/or articles of footwear. In some aspects of this technology, the bladders will form at least a portion of one or more footwear securing components, such as at least portions of straps and/or strap securing components, and/or at least a portion of one or more footwear upper components.

BACKGROUND

Conventional articles of footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

SUMMARY

This Summary is provided to introduce some general concepts relating to this technology in a simplified form that are further described below in the Detailed Description. This Summary is not intended to identify key features or essential features of the invention.

Aspects of this technology relate to bladders, footwear components including such bladders, and articles of footwear (e.g., sandals, slides, flip-flops, or other types of footwear, including athletic footwear) including such bladders, e.g., of the types described and/or claimed below and/or of the types illustrated in the appended drawings. In some aspects of this technology, the bladders will include bladder chambers and fluid passages configured to move fluid (e.g., when the footwear is secured to a wearer's foot) from beneath the wearer's foot to the securing strap(s) and/or strap securing member(s), which may form portions of an upper for the article of footwear. Such bladders, uppers, and/or articles of footwear may include any one or more structures, parts, features, properties, and/or combination(s) of structures, parts, features, and/or properties of the examples described and/or claimed below and/or of the examples illustrated in the appended drawings.

More specific aspects of this technology relate to bladder components for articles of footwear that include a first thermoplastic elastomer sheet and a second thermoplastic elastomer sheet joined to the first thermoplastic elastomer sheet by an outer perimeter bond. The first and second thermoplastic elastomer sheets may be formed from one thermoplastic elastomer sheet component (e.g., folded over along one or more edges) or two (or more) separate sheet components. An interior chamber (e.g., a fluid-tight chamber for containing a fluid, such as a gas) is defined between the first thermoplastic elastomer sheet and the second thermoplastic elastomer sheet and inside of the outer perimeter bond. The outer perimeter bond may be shaped such that the interior chamber forms: (i) a foot support chamber portion for supporting at least a portion of a plantar surface of a wearer's foot, and at least one of items (ii) or (iii) below, in which item (ii) comprises a first side chamber portion forming at least part of at least one securing strap, wherein the first side chamber portion extends outward from a first side of the foot support chamber portion and is in fluid communication with the foot support chamber portion, and in which item (iii) comprises a second side chamber portion forming at least a part of at least one strap-engaging member, wherein the second side chamber portion extends outward from a second side of the foot support chamber portion (e.g., which may be located opposite from the first side) and is in fluid communication with the foot support chamber portion. The strap-engaging member(s) is (are) configured to releasably hold the securing strap (s). In some examples of this technology, the strap(s) will be releasably held by the strap-engaging member(s) in a "hardware free" manner. For example, the strap-engaging member(s) may be integrally formed as part of the bladder component such that no separate hardware components are needed to releasably secure the strap(s) and hold the footwear to a wearer's foot.

Other aspects of this technology relate to bladder components for articles of footwear that include: a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond. This outer perimeter bond may be shaped such that the interior chamber forms: (i) a foot support chamber portion for supporting at least a portion of a plantar surface of a wearer's foot, wherein the foot support chamber portion includes a first side and a second side located opposite the first side, and (ii) a first side chamber portion forming at least part of a first footwear upper component, wherein the first side chamber portion extends outward from the first side of the foot support chamber portion and is in fluid communication with the foot support chamber portion. The outer perimeter bond further may be shaped such that the interior chamber forms a second side chamber portion (e.g., forming at least part of the first footwear upper component or a second footwear upper component), wherein the second side chamber portion extends outward from the second side of the foot support chamber portion and is in fluid communication with the foot support chamber portion. The first side chamber portion and the second side chamber portion may be releasably secured to one another, e.g., in a hardware free manner. Alternatively, at least one of the first side chamber portion and/or the second side chamber portion (if present) may be fixed in a footwear structure and/or may form at least a portion of an upper for an article of footwear. Additionally or alternatively, the bladder component further may include a fabric layer engaged with at least one of the first or second thermoplastic elastomer sheets.

While aspects of this technology are described in terms of bladders, footwear components including such bladders, and articles of footwear (e.g., sandals, slides, flip-flops, or other types of footwear, including athletic footwear) including such bladders, additional aspects of this technology relate to methods of making such bladders, footwear components, and/or articles of footwear and/or methods of using such bladders, footwear components, and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
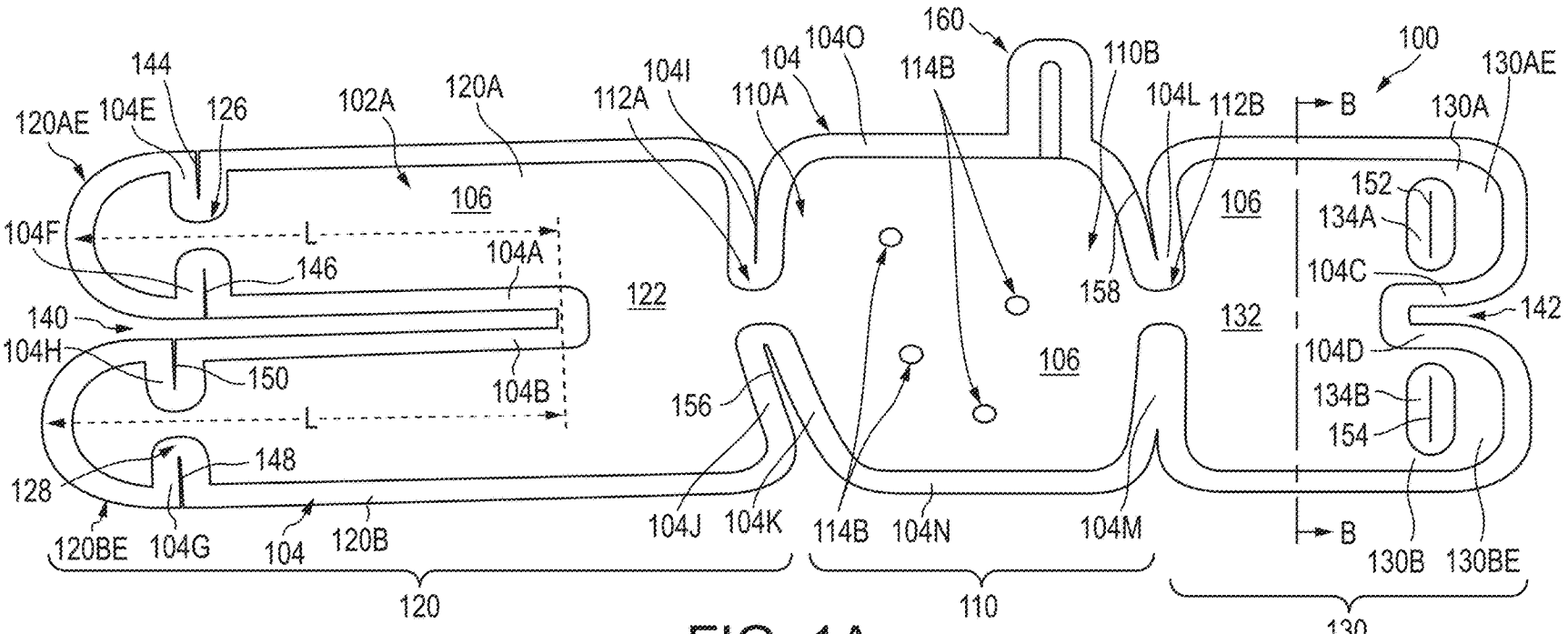
FIG. 1A illustrates a bladder component in accordance with some examples of this technology in a flatten orientation.

In the following description of various examples of bladders, footwear components, and/or articles of footwear according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

This application describes footwear components (e.g., bladder components, fabric layers, sole components, etc.) that are "bonded" together. The term "bonded" (and derivatives thereof) means that the components are joined securely to one another. The term "bonded" encompasses bonds formed using adhesives or cements (including hot melt adhesives) as well as bonds formed in an "adhesive free" manner, i.e., without use of a separate adhesive component. "Adhesive free" bonds include bonds formed by fusing or melting components together (e.g., if the components include compositions that are compatible to mix and join together to form a bond, such as two components including a thermoplastic polyurethane component); bonds formed by welding techniques (e.g., RF welding, ultrasonic welding, high-frequency welding, laser welding, impulse welding, etc.); bonds formed by heat sealing; etc. Some adhesive free bonds may form a seamless joint between the two previously separate components (e.g., the materials mix and join together and then re-harden with no discernible junction). The term "melt bond" and variations thereof, as used herein, mean bonds formed where localized melting of each component occurs (e.g., melting of the thermoplastic polymer present in each component), the melted components combine together, and then the combined components harden to thereby "fuse" and "bond" the two components together. Such melt bonded joints are adhesive free and may be seamless. The term "engaged with" is used herein as a generic term and includes both adhesive based bonds and adhesive free bonds within its scope as well as other potential types of engagement that fix two (or more) components together (including through the use of mechanical connectors or fasteners, through the use of sewing or stitching, etc.).

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure or structures. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that same component or feature in the claims).

Also, as used herein, the term "forefoot" (as in "forefoot portion," "forefoot region," or the like) relates to portions, regions, structures, or components located in and/or associated with a forward ⅓ of an article of footwear, sole structure, or component thereof; the term "midfoot" (as in "midfoot portion," "midfoot region," or the like) relates to portions, regions, structures, or components located in and/or associated with a middle ⅓ of an article of footwear, sole structure, or component thereof; and the terms "heel" or "rearfoot" (as in "heel portion," "heel region," "rearfoot portion," "rearfoot region," or the like) relate to portions, regions, structures, or components located in and/or associated with a rearward ⅓ of an article of footwear, sole structure, or component thereof.

I. GENERAL DESCRIPTION OF ASPECTS OF THIS TECHNOLOGY

As noted above, aspects of this technology relate to bladders, footwear components including such bladders, and articles of footwear (e.g., sandals, slides, flip-flops, or other types of footwear, including athletic footwear) including such bladders, e.g., of the types described and/or claimed below and/or of the types illustrated in the appended drawings. Such bladders, footwear components including such bladders, and articles of footwear including such bladders may include any one or more structures, parts, features, properties, and/or combination(s) of structures, parts, features, and/or properties of the examples described and/or claimed below and/or of the examples illustrated in the appended drawings.

Bladder components for articles of footwear in accordance with at least some aspects of this technology will include a first thermoplastic elastomer sheet and a second thermoplastic elastomer sheet joined to the first thermoplastic elastomer sheet by an outer perimeter bond. The first and second thermoplastic elastomer sheets may be formed from a single thermoplastic elastomer sheet component (e.g., folded over along one or more edges) or two (or more) separate sheet components. An interior chamber (e.g., a fluid-tight chamber for containing a fluid, such as a gas, optionally a gas under pressure) is defined between the first thermoplastic elastomer sheet and the second thermoplastic elastomer sheet and inside of the outer perimeter bond. In some examples of this technology, the outer perimeter bond is shaped such that the interior chamber forms: (i) a foot support chamber portion for supporting at least a portion of a plantar surface of a wearer's foot, and at least one of items (ii) or (iii) below, in which item (ii) comprises a first side chamber portion forming at least a part of at least a first securing strap (e.g., the first side chamber portion may form at least part of one or more securing straps), wherein the first side chamber portion extends outward from a first side of the foot support chamber portion and is in fluid communication with the foot support chamber portion, and in which item (iii) comprises a second side chamber portion forming at least a part of a first strap-engaging member (e.g., the second side chamber portion may form at least part of one or more strap-engaging members), wherein the second side chamber portion extends outward from a second side of the foot support chamber portion and is in fluid communication with the foot support chamber portion. The second side of the foot support chamber portion may be located on an opposite side of the foot support chamber portion from the first side of the foot support chamber portion. The first strap-engaging member may be configured to releasably hold the first securing strap. Any other strap-engaging members (e.g., a second strap-engaging member) may be configured to releasably hold other securing straps (e.g., a second securing strap), when present.

The outer perimeter bond may define a continuous interior chamber (e.g., a continuous fluid-tight chamber for containing a fluid, such as a gas, optionally a gas under pressure) forming: (a) the foot support chamber portion, and (b) the first side chamber portion and/or the second side chamber portion. The first side chamber portion may include a first connecting portion located adjacent the first side of foot support chamber portion, and the first securing strap (and optionally the second securing strap and any other securing straps present) may extend from the first connecting portion to a first strap free end (and to a second strap free end and to any other strap free ends of other straps). When multiple straps are present, the straps may be separated from one another by an opening (e.g., a cut, slit, or space defined in the outer perimeter bond). Thus, the outer perimeter bond may form strap defining segments separating the individual straps from one another within the first side chamber portion.

Additionally or alternatively, the second side chamber portion may includes a second connecting portion located adjacent the second side of the foot support chamber portion, and the first strap-engaging member (and optionally the second strap-engaging member and any other strap-engaging members present) may be located at a free end of the second side chamber portion located opposite from the second connecting portion. When multiple strap-engaging components are present, they may be separated from one another by at least one segment of the outer perimeter bond and/or by an opening (e.g., a cut, slit, or space defined in the outer perimeter bond).

In some examples of this technology, the strap(s) will be releasably held by the strap-engaging member(s) in a "hardware free" manner. For example, the strap-engaging member(s) may be integrally formed as part of the bladder component such that no separate hardware components are needed to releasably secure the strap(s). This may be accomplished, for example: (a) by forming the strap free end(s) to include one or more openings (e.g., a cut, slit, or space defined in the outer perimeter bond (e.g., within an inwardly extending segment of the outer perimeter bond)) and (b) by forming the strap-engaging member(s) as interior bonds within the second side chamber portion (e.g., where an interior surface of the first thermoplastic elastomer sheet is bonded (e.g., glued, welded, bonded, etc.) to an interior surface of the second thermoplastic elastomer sheet) and forming an opening (e.g., a cut, slit, or space) through the interior bond(s). Then, the first securing strap can be placed in a secured configuration by inserting the free end of the first securing strap through the opening in the interior bond of the first strap-engaging member. Other straps can be engaged with other strap-engaging members using similar structures and similar engagement techniques.

The outer perimeter bond also may separate the foot support chamber portion of the interior chamber from the first side chamber portion and/or the second side chamber portion. For example, one or more bond segments may be provided at the first side of the foot support chamber portion to separate the foot support chamber portion from the first side chamber portion. Additionally or alternatively, one or more bond segments may be provided at the second side of the foot support chamber portion to separate the foot support chamber portion from the second side chamber portion. Gaps in or between the outer perimeter bond segments at the sides of the foot support bladder portion may serve as fluid passageways to allow fluid communication between the foot support chamber portion and the first side chamber portion and/or the second side chamber portion.

In at least some examples of this technology, a fabric layer or other support layer may be engaged with an exterior surface of the first thermoplastic elastomer sheet and/or the second thermoplastic elastomer sheet. The fabric layer, when present, may make a more comfortable surface for contacting a wearer's foot, provide moisture wicking, etc.

Other aspects of this technology relate to bladder components for articles of footwear that include: a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond. This outer perimeter bond may be shaped such that the interior chamber forms: (i) a foot support chamber portion for supporting at least a portion of a plantar surface of a wearer's foot, wherein the foot support chamber portion includes a first side and a second side located opposite the first side, and (ii) a first side chamber portion forming at least part of a first footwear upper component, wherein the first side chamber portion extends outward from the first side of the foot support chamber portion and is in fluid communication with the foot support chamber portion. The outer perimeter bond further may be shaped such that the interior chamber forms a second side chamber portion (e.g., forming at least part of the first footwear upper component or a second footwear upper component), wherein the second side chamber portion extends outward from the second side of the foot support chamber portion and is in fluid communication with the foot support chamber portion. The first side chamber portion and the second side chamber portion may be releasably secured to one another, e.g., in a hardware free manner. Alternatively, at least one of the first side chamber portion and/or the second side chamber portion (if present) may be fixed in a footwear structure and/or may form at least a portion of an upper for an article of footwear. Additionally or alternatively, the bladder component further may include a fabric layer engaged with at least one of the first or second thermoplastic elastomer sheets.

Additional aspects of this technology relate to sole structures for articles of footwear that include a bladder component, e.g., of any of the types described above. Such sole structures may include: (a) a sole component; and (b) a bladder component of any of the types described above engaged with the sole component. The bladder component may be engaged with the sole component using one or more of: an adhesive bond, an adhesive free bond, one or more mechanical connectors, a fusing technique, a sewn seam, etc. In some examples, the foot support chamber portion of the bladder component may be engaged with the sole component (e.g., with a plantar support surface of the sole component). The sole component may include a recess (e.g., in its top, plantar support surface) into which at least a portion of the bladder component (e.g., the bottom of the foot support chamber portion) is received. The sole component may comprise one or more component parts, such as one or more midsole components (e.g., a foam sole component, a midsole component including one or more mechanical shock absorbing components, etc.) and/or one or more outsole components.

Still additional examples of this technology relate to articles of footwear that include: (a) a sole component and (b) a bladder component of any of the types described above engaged with the sole component (e.g., in any of the manners described above). The sole component may comprise one or more component parts, such as one or more midsole components (e.g., a foam sole component, a midsole component including one or more mechanical shock absorbing components, etc.) and/or one or more outsole components. In such articles of footwear, the first side chamber portion and the second side chamber portion may comprise at least portions of an upper for the article of footwear. In some more specific examples, the first securing strap and the first strap-engaging member (and any other securing straps and/or strap-engaging members present) may comprise at least portions of an upper for the article of footwear. Such articles of footwear may include strap securing systems that are "hardware free," in which the strap securing parts are formed only of and the strap securing functions are performed only by structures integrally formed as part of the bladder component structure. Articles of footwear in accordance with some examples of this aspect of the present technology may form a sandal, slide, flip-flop, or other types of footwear, including athletic footwear.

Still additional examples of this technology relate to articles of footwear that consist only of or consist essentially of: (a) a sole component and (b) a bladder component of any of the types described above engaged with the sole component (e.g., in any of the manners described above). The sole component may comprise one or more component parts, such as one or more midsole components (e.g., a foam sole component, a midsole component including one or more mechanical shock absorbing components, etc.) and/or one or more outsole components. In such articles of footwear, the first side chamber portion and the second side chamber portion may comprise an upper for the article of footwear. In some more specific examples, the first securing strap and the first strap-engaging member (and any other securing straps and/or strap-engaging members present) may comprise an upper for the article of footwear. Such articles of footwear may include strap securing systems that are "hardware free," in which the strap securing parts are formed only of and the strap securing functions are performed only by structures integrally formed as part of the bladder component structure. Articles of footwear in accordance with some examples of this aspect of the present technology may form a sandal, slide, flip-flop, or other types of footwear, including athletic footwear.

Further aspects of this technology relate to footwear components (e.g., foot sole structures) and/or articles of footwear including bladders of the various types described above. Still additional aspects of this technology relate to methods of making the bladders, footwear components, and/or articles of footwear described above.

Given the general description of features, examples, aspects, structures, and methods according to examples of the technology provided above, a more detailed description of specific example footwear uppers, bladders, articles of footwear, and methods in accordance with this technology follows.

II. DETAILED DESCRIPTION OF EXAMPLE BLADDERS, FOOTWEAR COMPONENTS, AND/OR ARTICLES OF FOOTWEAR ACCORDING TO THIS TECHNOLOGY

Figure 1B:
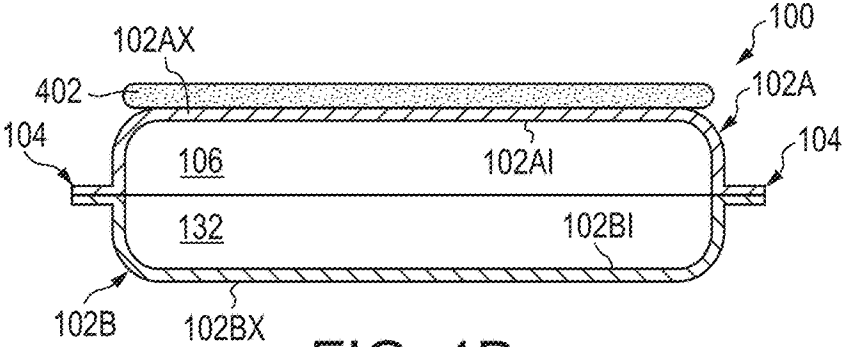
FIG. 1B illustrates a cross sectional view of the bladder component of FIG. 1A taken along line B-B in FIG. 1A.

FIGS. 1A and 1B illustrate a bladder component 100 for an article of footwear in accordance with some examples of this technology. In the view of FIG. 1A, the bladder component 100 is in a flat and unsecured configuration, and FIG. 1B constitutes a cross sectional view along line B-B in FIG. 1A. The bladder component 100 comprises a first thermoplastic elastomer sheet 102A (having an interior surface 102AI and an exterior surface 102AX) and a second thermoplastic elastomer sheet 102B (having an interior surface 102BI and an exterior surface 102BX). The two thermoplastic elastomer sheets 102A, 102B are joined together (at interior surfaces 102AI, 102BI) by an outer perimeter bond 104. The two thermoplastic elastomer sheets 102A, 102B may be joined together in any desired manner, including in manners conventionally known and used in the footwear arts, e.g., via adhesives, via bonding techniques using heat and/or pressure, via melt bonding, via welding techniques (e.g., RF welding, ultrasonic welding, etc.), etc.

An interior chamber 106 is defined between the first thermoplastic elastomer sheet 102A and the second thermoplastic elastomer sheet 102B and inside of the outer perimeter bond 104. Thus, the outer perimeter bond 104 and the thermoplastic elastomer sheets 102A, 102B in this example form a single, continuous, gas-tight (sealed), interior chamber 106. While the outer perimeter bond 104 of this example extends around 100% of the outer perimeter of the bladder component 100, this is not a requirement. For example, if the first thermoplastic elastomer sheet 102A and the second thermoplastic elastomer sheet 102B constitute portions of a single sheet of thermoplastic elastomer material (e.g., that is folded on at least one edge), the outer perimeter bond 104 could form a sealed bond between overlapping portions of the first thermoplastic elastomer sheet 102A and the second thermoplastic elastomer sheet 102B at locations other than at the fold.

The outer perimeter bond 104 of this illustrated example is shaped such that the interior chamber 106 forms a foot support chamber portion 110 for supporting at least a portion of a plantar surface of a wearer's foot. As shown in FIG. 1A, the foot support chamber portion 110 includes one or more spot welds or bonds 114B where the interior surface 102AI of the first thermoplastic elastomer sheet 102A is fixed to the interior surface 102BI of the second thermoplastic elastomer sheet 102B. These spot welds or bonds (or other structures) help control the shape of the bladder system 100 when it is inflated. The term "spot weld or bond," as used herein in this context, means a bonded engagement of two facing interior surfaces of the thermoplastic elastomer sheets (e.g., surfaces 102AI and 102BI) having no dimension greater than 10 mm (e.g., bonded at "spots" having a radius of 5 mm or less).

The outer perimeter bond 104 further is shaped to define a first side chamber portion 120 extending outward from a first side 110A of the foot support chamber portion 110. The first side chamber portion 120 in this example is located on a medial side of the foot support chamber portion 110

(although it could be located on the lateral side, if desired). The first side chamber portion 120 is in fluid communication with the foot support chamber portion 110. More specifically, in this example, the portion of the interior chamber 106 within the first side chamber portion 120 may freely exchange fluid with the portion of the interior chamber 106 within the foot support chamber portion 110, e.g., via one or more fluid passageways, such as fluid passageway 112A. In at least some examples of this technology, no valves, stop members, or other structures are present that would stop, alter, or control fluid flow between foot support chamber portion 110 and the first side chamber portion 120 (i.e., fluid can freely flow between these chamber portions 110, 120, e.g., via one or more fluid passageways such as fluid passageway 112A). In the illustrated example, the first side chamber portion 120 and the fluid passageway 112A connecting it to the foot support chamber portion 110 are located in a forefoot and/or midfoot region of the overall bladder system 100 (and/or within a forefoot region and/or midfoot region of a sole structure and/or article of footwear including such a bladder system 100).

Also, in this illustrated example, the first side chamber portion 120 forms a first securing strap 120A and a second securing strap 120B (although more or fewer securing straps could be provided, if desired). As shown in FIG. 1A, the interior chamber 106 may extend into the first securing strap 120A and the second securing strap 120B (optionally to the strap free ends 120AE, 120BE) such that each of the first securing strap 120A and the second securing strap 120B forms an elongated fluid-filled chamber segment. Alternatively, rather than one or more securing straps, first side chamber portion 120 may form any type of footwear upper component structure (not necessarily a securing strap). In some examples, the first side chamber portion 120 may be releasably engaged with or permanently fixed to another footwear upper component.

As further shown in FIG. 1A, the outer perimeter bond 104 of this example includes a first strap defining segment 104A and a second strap defining segment 104B. An opening 140 separates the first strap defining segment 104A from the second strap defining segment 104B and separates the first securing strap 120A from the second securing strap 120B. The opening 140 separating the outer perimeter bond 104 segments 104A and 104B may be less than 2 cm wide, and in some examples, less than 1 cm wide, or it even may constitute a slit or cut.

The outer perimeter bond 104 of this illustrated example further is shaped to define a second side chamber portion 130 extending outward from a second side 110B of the foot support chamber portion 110. The second side chamber portion 130 in this example is located on a lateral side of the foot support chamber portion 110 (although it could be located on the medial side, if desired). The second side chamber portion 130 is in fluid communication with the foot support chamber portion 110. More specifically, the portion of the interior chamber 106 within the second side chamber portion 130 may freely exchange fluid with the portion of the interior chamber 106 within the foot support chamber portion 110, e.g., via one or more fluid passageways, such as fluid passageway 112B. In at least some examples of this technology, no valves, stop members, or other structures are present that would stop, alter, or control fluid flow between foot support chamber portion 110 and the second side chamber portion 130 (i.e., fluid can freely flow between these chamber portions 110, 130, e.g., via one or more fluid passageways such as fluid passageway 112B). In the illustrated example, the second side chamber portion 130 and the fluid passageway 112B connecting it to the foot support chamber portion 110 are located in a forefoot and/or midfoot region of the overall bladder system 100 (and/or within a forefoot region and/or midfoot region of a sole structure and/or article of footwear including such a bladder system 100).

Also, in this illustrated example, the second side chamber portion 130 forms a first strap-engaging member 130A and a second strap-engaging member 130B (although more or fewer strap-engaging members could be provided, if desired). The first strap-engaging member 130A and the second strap-engaging member 130B are configured to releasably hold the first securing strap 120A and the second securing strap 120B, respectively, as will be described in more detail below. As shown in FIG. 1A, the interior chamber 106 may extend into the first strap-engaging member 130A and the second strap-engaging member 130B (optionally to their free ends 130AE, 130BE). Alternatively, rather than one or more strap-engaging members, second side chamber portion 130 may form any type of footwear upper component structure (not necessarily a securing strap). Second side chamber portion 130, when present, also may be releasably engaged with, permanently fixed to, or separated from the first side chamber portion 120 (and/or optionally engaged with another footwear upper component).

FIG. 1A further illustrates that the first side chamber portion 120 of this example includes a first connecting portion 122 located within the interior chamber 106 and adjacent the first side 110A of the foot support chamber portion 110. The connecting portion 122 is in fluid communication with the foot support chamber portion 110 via fluid passageway 112A. In this illustrated example, the first securing strap 120A and the second securing strap 120B (and their interior chambers) meet (or originate) at the first connecting portion 122 and extend outward from the first connecting portion 122 to their respective strap free ends 120AE, 120BE. While the fluid-containing interior chamber 106 of this example extends along the securing straps 120A, 120B to locations at or near their free ends 120AE, 120BE, the fluid-containing chamber 106 could extend a greater or lesser distance along the longitudinal length of the securing straps 120A, 120B. In some more specific examples of this technology, the fluid-containing interior chamber of the securing straps 120A, 120B will extend at least 50% of the longitudinal length L of the securing straps 120A, 120B (and in some examples, at least 60%, at least 75%, at least 80%, or even at least 90% of the respective strap 120A, 120B's longitudinal length L).

Additionally or alternatively, the second side chamber portion 130 of this example includes a second connecting portion 132 located within the interior chamber 106 and adjacent the second side 110B of the foot support chamber portion 110. The connecting portion 132 is in fluid communication with the foot support chamber portion 110 via fluid passageway 112B. In this illustrated example, interior chambers of the first strap-engaging member 130A and the second strap-engaging member 130B (and their interior chambers) meet (or originate) at the second connecting portion 132 and extend outward from the second connecting portion 132 to their respective free ends 130AE, 130BE. While other options are possible, in this illustrated example, the first strap-engaging member 130A and the second strap-engaging member 130B are separated from one another by at least one segment (two segments 104C, 104D shown) of the outer perimeter bond 104. An opening 142 (e.g., a cut, slit, space, etc.) extends between and separates segments 104C, 104D in this example. The opening 142 separating the outer perimeter bond 104 segments 104C and 104D may be less than 2 cm wide, and in some examples, less than 1 cm wide, or it even may constitute a slit or cut.

Figure 2:
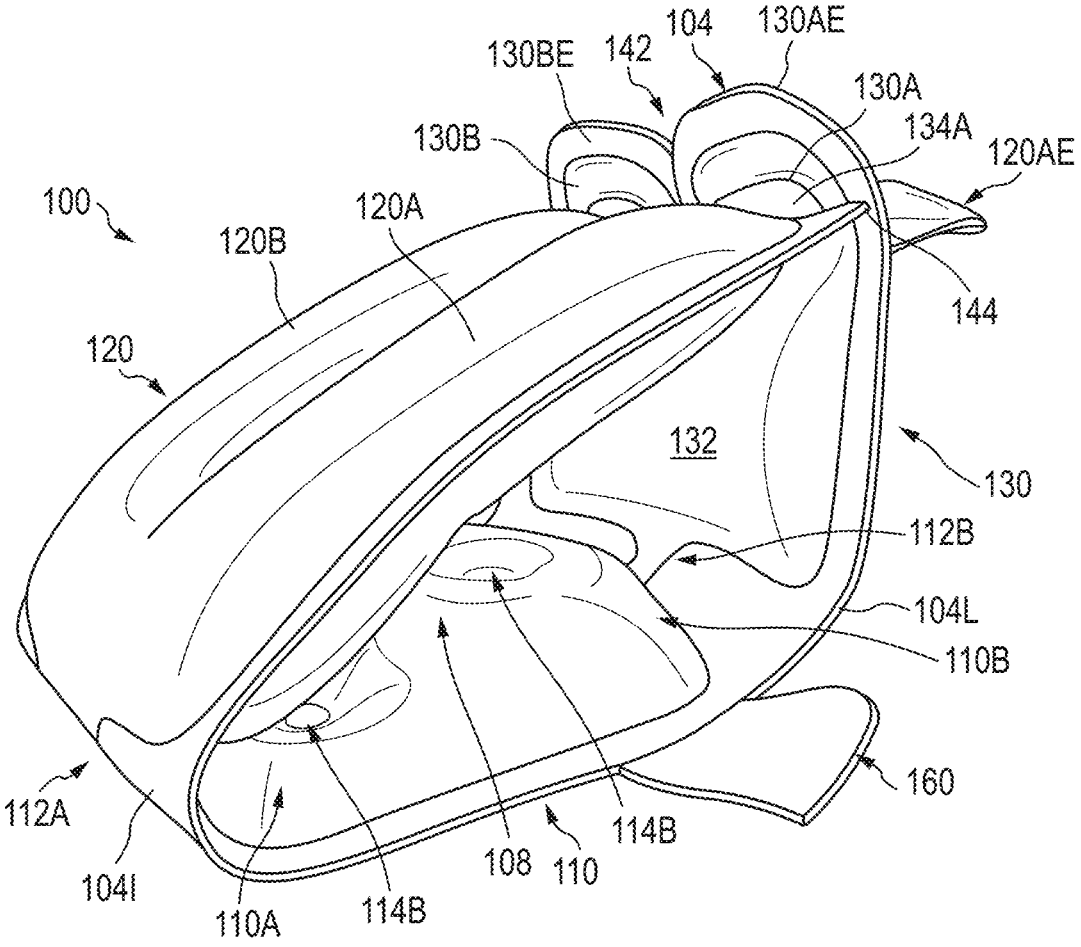
FIG. 2 illustrates an example bladder component in accordance with some examples of this technology in an inflated condition and in a secured configuration.
Figure 3A:
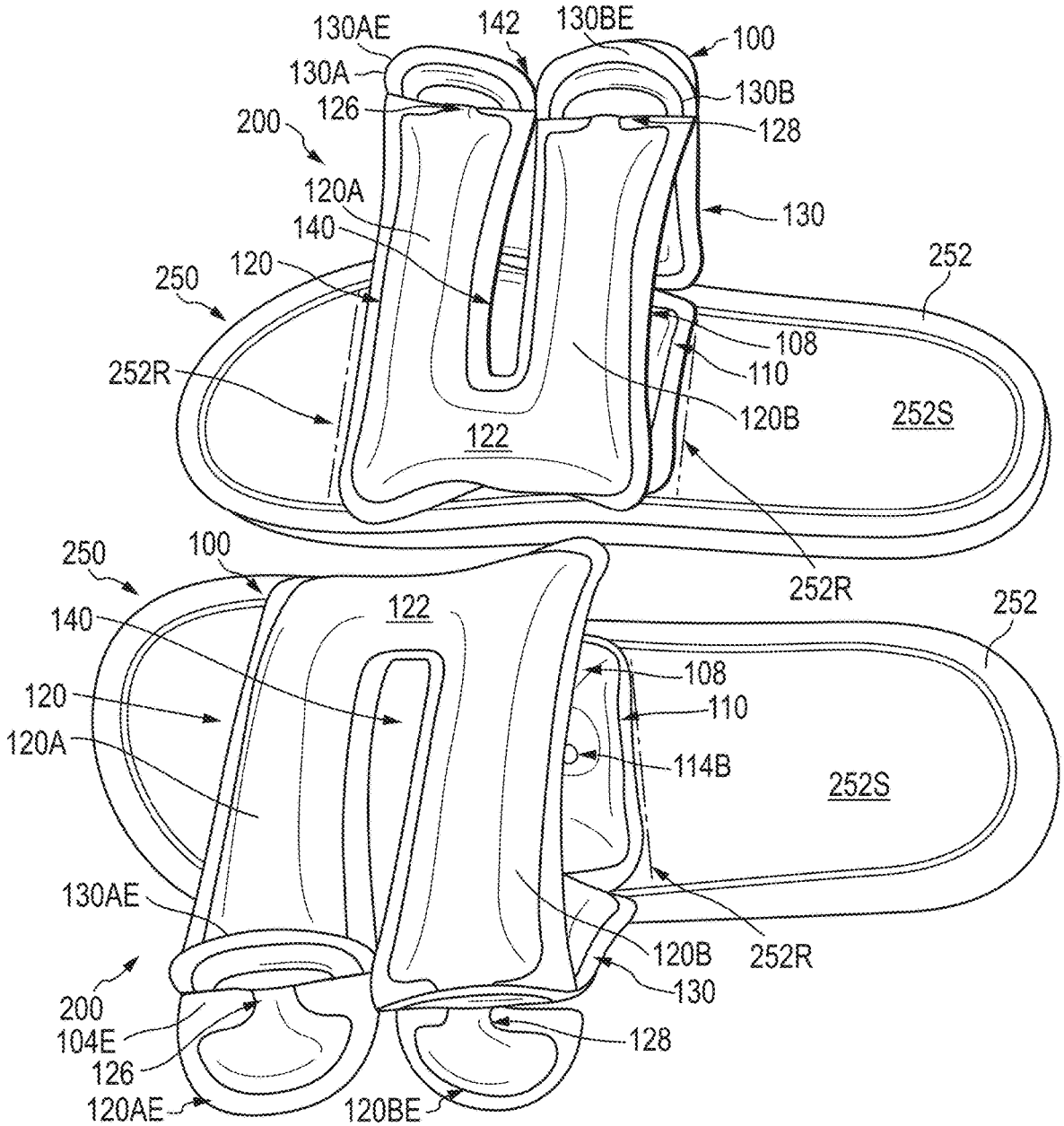
FIGS. 3A and 3B provide various views of articles of footwear in accordance with some examples of this technology.
Figure 3B:
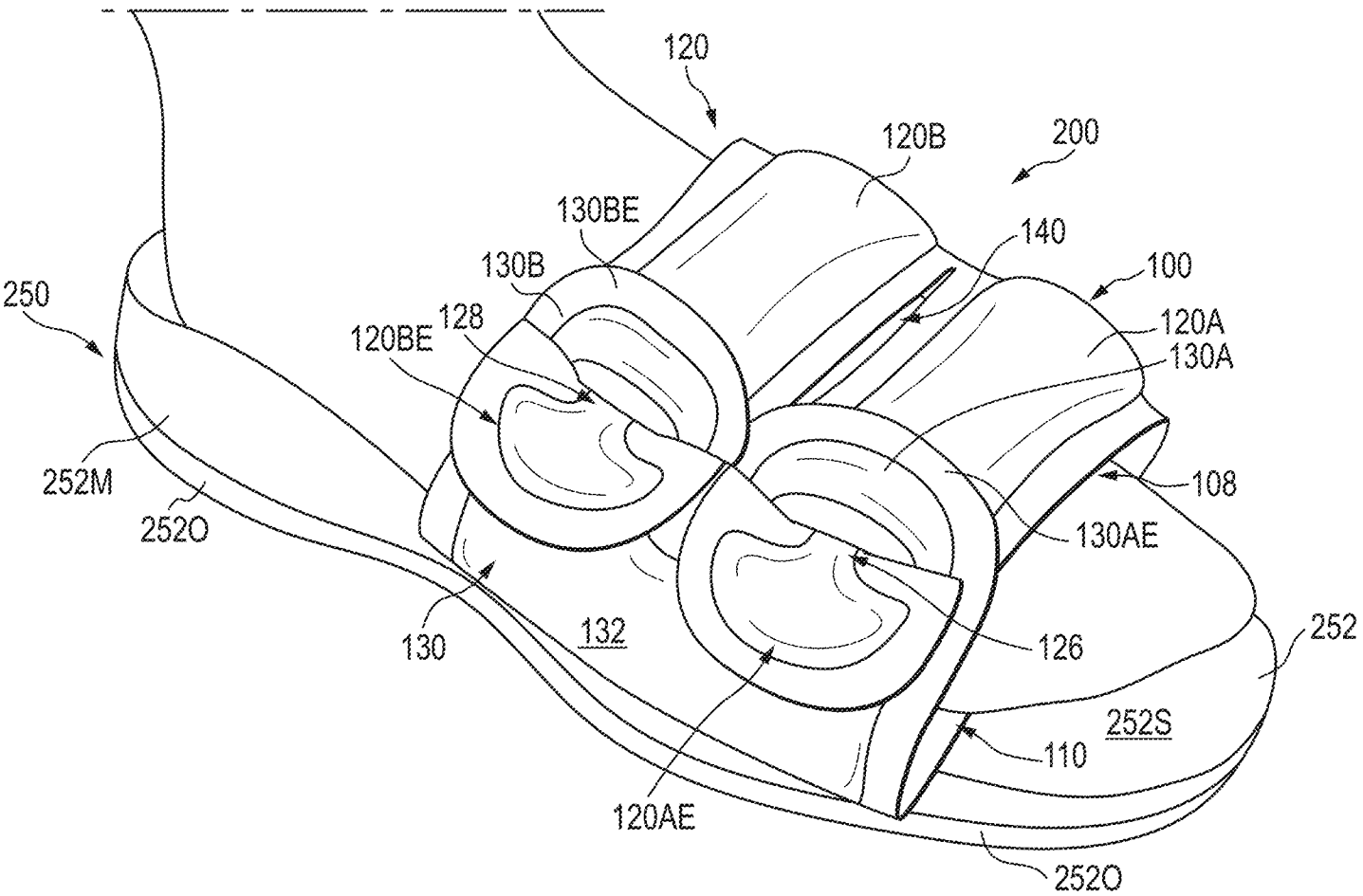

When inflated with gas (e.g., as shown in FIGS. 2-3B), the foot support chamber portion 110 may contain a first volume of gas ($V_{110}$), the first side chamber portion 120 may contain a second volume of gas ($V_{120}$), and the third side chamber portion 130 may contain a third volume of gas ($V_{130}$). These chamber volumes may have any one or more and/or any combination of the following properties:

| | |
|---|---|
| $V_{120} = 1 \times V_{110}$ to $3 \times V_{110}$ | $V_{120} = 1.25 \times V_{130}$ to $3 \times V_{130}$ |
| $V_{120} = 1.25 \times V_{110}$ to $2.5 \times V_{110}$ | $V_{120} = 1.5 \times V_{130}$ to $2.5 \times V_{130}$ |
| $V_{110} = 0.75 \times V_{130}$ to $2.5 \times V_{130}$ | $V_{110} = 1 \times V_{130}$ to $2 \times V_{130}$ |
| $V_{120} = 1.25 \times V_{110}$ to $2.5 \times V_{110}$ | $V_{120} = 1.5 \times V_{130}$ to $2.5 \times V_{130}$ |
| $V_{120}$ = At least 80 $cm^3$ | $V_{120}$ = 80 $cm^3$ to 800 $cm^3$ |
| $V_{120}$ = 100 $cm^3$ to 700 $cm^3$ | $V_{120}$ = 150 $cm^3$ to 600 $cm^3$ |
| $V_{110}$ = At least 50 $cm^3$ | $V_{110}$ = 50 $cm^3$ to 500 cm |
| $V_{110}$ = 60 $cm^3$ to 450 $cm^3$ | $V_{110}$ = 75 $cm^3$ to 400 $cm^3$ |
| $V_{130}$ = At least 50 $cm^3$ | $V_{130}$ = 50 $cm^3$ to 500 cm |
| $V_{130}$ = 60 $cm^3$ to 450 $cm^3$ | $V_{130}$ = 75 $cm^3$ to 400 $cm^3$ |

For the individual straps 120A, 120B of the first side chamber portion 120, each individual strap 120A, 120B may have a volume ($V_{Strap}$) having any one or more and/or any combination of the following properties: at least 40 $cm^3$; 40 $cm^3$ to 400 $cm^3$; 50 $cm^3$ to 350 $cm^3$; and/or $cm^3$ to 300 $cm^3$. $V_{Strap}$ constitutes the volume defined within the longitudinal length L of a strap, from its origin (e.g., at the connecting portion 122) to its free end (e.g., 120AE, 120BE). See FIG. 1A.

The side chamber portions 120, 130 may include fluid over any desired proportion of the area of the side chamber portion(s) 120, 130. For example, one or both of the side chamber portions 120, 130 may define a "fluid containing area" ($A_{FC}$) as the area of that side chamber portion 120, 130 where the interior chamber 106 lies (e.g., the combined area within an individual side chamber portion 120, 130 including the interior chamber 106 and not counting any interior bond area and/or not counting the area taken up by the outer perimeter bond 104). One or both side chamber portions 120, 130 also define a total area ($A_T$) as the area of the side chamber portion 120, 130 defined by the outer edge of the outer perimeter bond 104 (e.g., cutting through the any fluid passageways, such as 112A, 112B). In at least some examples of this technology, in each individual side chamber portion 120, 130, the fluid containing area ($A_{FC}$) may comprise at least 50% of the side chamber portion 120, 130 total area ($A_T$). In some examples, for either or both of the individual side chamber portions 120 and/or 130, the "fluid containing area" ($A_{FC}$) will comprise from 50% to 98%, from 55% to 95%, from 60% to 90%, or even from 65% to 85% of the overall side chamber portion 120, 130 area ($A_T$).

As mentioned above, in at least some examples of this technology, the bladder component 100 may be structured such that the strap(s) (e.g., 120A and/or 120B) will be releasably held by the strap-engaging member(s) (e.g., 130A and/or 130B) in a "hardware free" manner. In other words, in at least some examples of this technology, all components for releasably fixing the strap(s) (e.g., 120A and/or 120B) with the strap-engaging member(s) (e.g., 130A and/or 130B) may be integrally formed as part of the bladder component 100 such that no separate hardware components need be provided. Examples of structures for accomplishing this type of "hardware free" connection are described below.

As shown in FIG. 1A, in this example bladder component 100 structure, at the free strap end 120AE, the outer perimeter bond 104 includes: (a) a first inwardly extending bond segment 104E, (b) a first opening 144 (e.g., a slit, cut, or gap) extending through the outer perimeter bond 104 at the first inwardly extending bond segment 104E, (c) a second inwardly extending bond segment 104F, and (d) a second opening 146 (e.g., a slit, cut, or gap) extending through the outer perimeter bond 104 at the second inwardly extending bond segment 104F. It this example structure, the first inwardly extending bond segment 104E and the first opening 144 extend toward the second inwardly extending bond segment 104F and the second opening 146. If desired (and as shown in the example of FIG. 1A), a fluid passage 126 is defined within the first securing strap 102A between the first inwardly extending bond segment 104E and the second inwardly extending bond segment 104F. In this manner, fluid can extend into the region adjacent the strap free end 102AE beyond the locations of the first inwardly extending bond segment 104E, the first opening 144, the second inwardly extending bond segment 104F, and the second opening 146. Alternatively, if desired, the interior chamber 106 of the first side chamber portion 120 could terminate short of the openings 144, 146. As another alternative, a single inwardly extending bond (e.g., 104E) and a single opening through it (e.g., 144) could be provided near the strap free end 120AE.

The second strap free end 120BE may include similar structures. More specifically, the outer perimeter bond 104 may include: (a) a third inwardly extending bond segment 104G, (b) a third opening 148 (e.g., a slit, cut, or gap) extending through the outer perimeter bond 104 at the third inwardly extending bond segment 104G, (c) a fourth inwardly extending bond segment 104H, and (d) a fourth opening 150 (e.g., a slit, cut, or gap) extending through the outer perimeter bond 104 at the fourth inwardly extending bond segment 104H. As shown, in this illustrated example, the third inwardly extending bond segment 104G and the third opening 148 extend toward the fourth inwardly extending bond segment 104H and the fourth opening 150. If desired (and as shown in the example of FIG. 1A), a fluid passage 128 is defined within the second securing strap 120B between the third inwardly extending bond segment 104G and the fourth inwardly extending bond segment 104H. In this manner, fluid can extend into the region adjacent the strap free end 102BE beyond the locations of the third inwardly extending bond segment 104G, the third opening 148, the fourth inwardly extending bond segment 104H, and the fourth opening 150. Alternatively, if desired, the interior chamber 106 of the first side chamber portion 120 could terminate short of the openings 148, 150. As another alternative, a single inwardly extending bond (e.g., 104G) and a single opening through it (e.g., 148) could be provided near the strap free end 120BE.

"Hardware free" securing structures also may be included as part of the second side chamber portion 130. In this illustrated example, these structures include the first strap-engaging member 130A and the second strap-engaging member 130B. The first strap-engaging member 130A of this example includes a first interior bond 134A formed between the first thermoplastic elastomer sheet 102A and the second thermoplastic elastomer sheet 102B (e.g., a bond between interior surface 102AI and interior surface 102BI). A fifth opening 152 (e.g., a slit, cut, or gap) extends through the first interior bond 134A. Similarly, in this illustrated example, the second strap-engaging member 130B includes a second interior bond 134B formed between the first thermoplastic elastomer sheet 102A and the second thermoplastic elastomer sheet 102B (e.g., a bond between interior surface 102AI and interior surface 102BI). A sixth opening 154 (e.g., a slit, cut, or gap) extends through the second interior bond 134B.

In use, to place the first securing strap 120A in a secured configuration or condition, a user will (a) bend or fold the side edges of the free end 120AE toward one another at openings 144, 146 (e.g., which may pinch fluid passage 126 (if present) toward a closed condition), (b) move the first securing strap 120A toward the first strap-engaging member 130A, and (c) extend the first strap free end 120AE (while the side edges are bent or folded) into and through the fifth opening 152 in the first interior bond 134A. Once through the fifth opening 152, the first strap free end 120AE will return to or toward its original configuration (e.g., unfold and flatten out), and the first and second openings 144, 146 will extend around the ends of fifth opening 152. See FIGS. 2-4. The second securing strap 120B may be placed in a secured configuration or condition in a similar manner. For example, a user will (a) bend or fold the side edges of the free end 120BE toward one another at openings 148, 150 (e.g., which may pinch fluid passage 128 (if present) toward a closed condition), (b) move the second securing strap 120B toward the second strap-engaging member 130B, and (c) extend the second strap free end 120BE (while the side edges are bent or folded) into and through the sixth opening 154 in the second interior bond 134B. Once through the sixth opening 154, the second strap free end 120BE will return to or toward its original configuration (e.g., unbend and flatten out), and the third and fourth openings 148, 150 will extend around the ends of sixth opening 154.

In at least some examples of this technology (e.g., when fluid passages 126 and 128 are present, allowing fluid to move to a location proximate to the free ends 102AE, 102BE, respectively), when the straps 120A, 120B are in their secured configuration or state, the first fluid passage 126 will extend through the fifth opening 152 formed in the first interior bond 134A and the second fluid passage 128 will extend through the sixth opening 154 formed in the second interior bond 134B. Alternatively, if desired, the interior chamber 106 of the first side chamber portion 120 could terminate short of the openings 144, 146 and/or short of the openings 148, 150. The strap(s) 120A, 120B can be released (or moved to an unsecured configuration) in somewhat the opposite manner, e.g., by: (a) folding or bending the ends at openings 144, 146 and/or 148, 150, respectively, and (b) pulling the strap free ends 120AE, 120BE (while bent or folded) out of openings 152, 154, respectively.

In this illustrated structure, at least the first side chamber portion 120 (and, optionally, the second side chamber portion 130) may be structured and arranged to extend over an instep portion of a wearer's foot (e.g., in a midfoot and/or forefoot region of the article of footwear 200). These side chamber portions 120, 130, together with the foot support chamber portion 110, define a foot receiving chamber 108 for the article of footwear.

The outer perimeter bond 104 may include additional features that enable the first side chamber portion 120 and the second side chamber portion 130 to form at least a portion of an upper for the article of footwear. For example, as shown in FIG. 1A, the outer perimeter bond 104 may include a first bond segment 104I separating the foot support chamber portion 110 and the first side chamber portion 120 at the first side 110A of the foot support chamber portion 110. Additionally, in this illustrated example, the outer perimeter bond 104 includes a second bond segment 104J and a third bond segment 104K separated by an opening 156 (e.g., a cut, slit, or opening) separating the foot support chamber portion 110 and the first side chamber portion 120 at the first side 110A of the foot support chamber portion 110. The first bond segment 104I of this example extends toward (but not to) the second bond segment 104J and the third bond segment 104K to define the first side fluid passageway 112A extending between the first bond segment 104I and the second and third bond segments 104J, 104K. This first side fluid passageway 112A places the first side chamber portion 120 in fluid communication with the foot support chamber portion 110. The bond segments 104I, 104J, and 104K in this example also provide a fold line to allow the first side chamber portion 120 to rotate upward with respect to the foot support chamber portion 110 and form at least a portion of an upper for an article of footwear. See FIGS. 2-4.

Additionally or alternatively, in some examples of this technology, the outer perimeter bond 104 may include: (i) a fourth bond segment 104L separating the foot support chamber portion 110 and the second side chamber portion 130 at the second side 110B of the foot support chamber portion 110, and (ii) a fifth bond segment 104M separating the foot support chamber portion 110 and the second side chamber portion 130 at the second side 110B of the foot support chamber portion 110. If desired, as shown in FIG. 1A, the fourth bond segment 104L may include two bond segments separated by an opening 158 (e.g., cut, slit, or gap). The fourth bond segment 104L of this example extends toward the fifth bond segment 104M to define the second side fluid passageway 112B extending between the fourth bond segment 104L and the fifth bond segment 104M. This second side fluid passageway 112B places the second side chamber portion 130 in fluid communication with the foot support chamber portion 110. The bond segments 104L and 104M in this example also provide a fold line to allow the second side chamber portion 130 to rotate upward with respect to the foot support chamber portion 110 and form at least a portion of an upper for an article of footwear. See FIGS. 2-4.

FIG. 1A further illustrates that this example bladder component 100 includes an inflation port 160 defined by the outer perimeter bond 104. The inflation port 160 allows access to the interior chamber 106 of the bladder component 100 to allow air (or other gas or fluid) to be introduced. The inflation port 160 then may be sealed (e.g., permanently sealed) after the bladder component 100 is inflated. While FIG. 1A shows the inflation port 160 extending from the foot support chamber portion 110, it could be provided at other locations, e.g., in the first side chamber portion 120 or the second side chamber portion 130. Additionally or alternatively, multiple inflation ports could be provided in some examples of this technology.

As shown in FIG. 1A, in this illustrated example, the foot support chamber portion 110 includes an outer sealed edge as part of the outer perimeter bond 104 (e.g., the outer sealed edge including bond segments 104I, 104K, 104L, 104M, 104N, and 104O). This outer sealed edge includes breaks defining: (a) the first side passageway 112A providing fluid communication with the first side chamber portion 120 and (b) the second side passageway 112B providing fluid communication with the second side chamber portion 130. Thus, the outer sealed edge defining the foot support chamber portion 110 extends less than 100% of the entire perimeter of the foot support chamber portion 110. As some more specific examples, the outer sealed edge defining the foot support chamber portion 110 may extend around at least 75%, at least 80%, at least 90%, or even at least 95% of the entire outer periphery of foot support chamber portion 110

(e.g., as defined by the bond segments 104I, 104K, 104L, 104M, 104N, and 104O). Also, any desired number of fluid passageways 112A, 112B may be provided through this outer sealed edge.

FIG. 2 illustrates a bladder component 100 of the type shown in FIGS. 1A and 1B inflated and in a secured configuration. As shown in FIG. 2, some bladder components 100 in accordance with aspects of this technology may include a high volume of gas to provide a relatively "bulbous" look. As some more specific examples, the overall bladder component 100 may contain (within interior chamber 106) a total volume of at least 180 $cm^3$, and in some examples, a total volume within a range of 180 $cm^3$ to 1800 $cm^3$, from 220 $cm^3$ to 1500 $cm^3$, from 280 $cm^3$ to 1200 $cm^3$, or even from 320 $cm^3$ to 1000 $cm^3$.

FIGS. 3A and 3B provide views of articles of footwear 200 and sole structures 250 in accordance with at least some examples of this technology. The articles of footwear 200 in these illustrated examples include sandal, slide, or flip-flop structures that have a base sole component 252 and a bladder component 100 of the types described above engaged with the sole component 252 (e.g., engaged with a plantar support surface 252S of the sole component 252). The bladder component 100 (e.g., at least the foot support chamber portion 110) may be received in a recess 252R defined in the plantar support surface 252S of the sole component 252 and may be engaged with the sole component 252 (e.g., engaged with the plantar support surface 252S in the recess 252R).

The bladder component 100 may be engaged with the sole component 252 in any desired manner, such as by adhesives, by mechanical connectors (e.g., extending through the interior welds or bonds 114B in the foot support chamber portion 110), by sewing, etc. While other options are possible, in this illustrated example, the sole component 252 comprises a foam component that extends to support an entire plantar surface of a wearer's foot. An article of footwear 200 in accordance with at least some examples of this technology may include multiple sole component parts, e.g., one or more of: one or more foam base components (e.g., 252M), one or more internal fluid-filled bladders, one or more mechanical connectors, one or more outsole components (e.g., 252O), etc.

Also, FIGS. 3A and 3B show the foot support chamber portion 110 of the bladder component 100 sized, shaped, and configured to support a midfoot to forefoot portion of a wearer's foot. Also, the foot support chamber portion 110 has a longitudinal dimension (in the front-to-back direction of the article of footwear 200) that generally corresponds to the longitudinal dimensions of the first side bladder chamber portion 120 and the second side bladder chamber portion 130. Other options are possible. For example, the foot support chamber portion 110 could extend to support a greater or lesser portion of the wearer's foot (e.g., extend to provide a heel support portion, a toe support portion, and/or an arch support portion of a wearer's foot). Additionally or alternatively, the foot support chamber portion 110 could extend forward and/or rearward, optionally beyond the forward and/or rearward edges of the first side bladder chamber portion 120 and/or the second side bladder chamber portion 130.

As further shown in FIGS. 3A and 3B, in at least some examples of this technology, the first side chamber portion 120 and the second side chamber portion 130 may form at least a portion of an upper for the article of footwear 200. In these illustrated examples, the article of footwear 200 consists of (or consists essentially of) the sole structure 250 (e.g., sole component 252) and the bladder component 100. The article of footwear 200 may be secured to a wearer's foot in a "hardware free" manner, e.g., using securing structures integrally formed as part of the bladder component 100 as described above.

In use, when a wearer dons the article of footwear 200, downward force on the foot support chamber portion 110 from the wearer's foot will move fluid through the first side fluid passageway 112A and the second side fluid passageway 112B and into the first side chamber portion 120 and the second side chamber portion 130, respectively. The fluid moving into the first side chamber portion 120 and/or the second side chamber portion 130 may displace or expand the first side chamber portion 120 and/or the second side chamber portion 130 into contact with the wearer's foot (e.g., in the instep area). This movement of fluid may help maintain secure contact with the wearer's foot and provide a comfortable feel.

Figure 4:
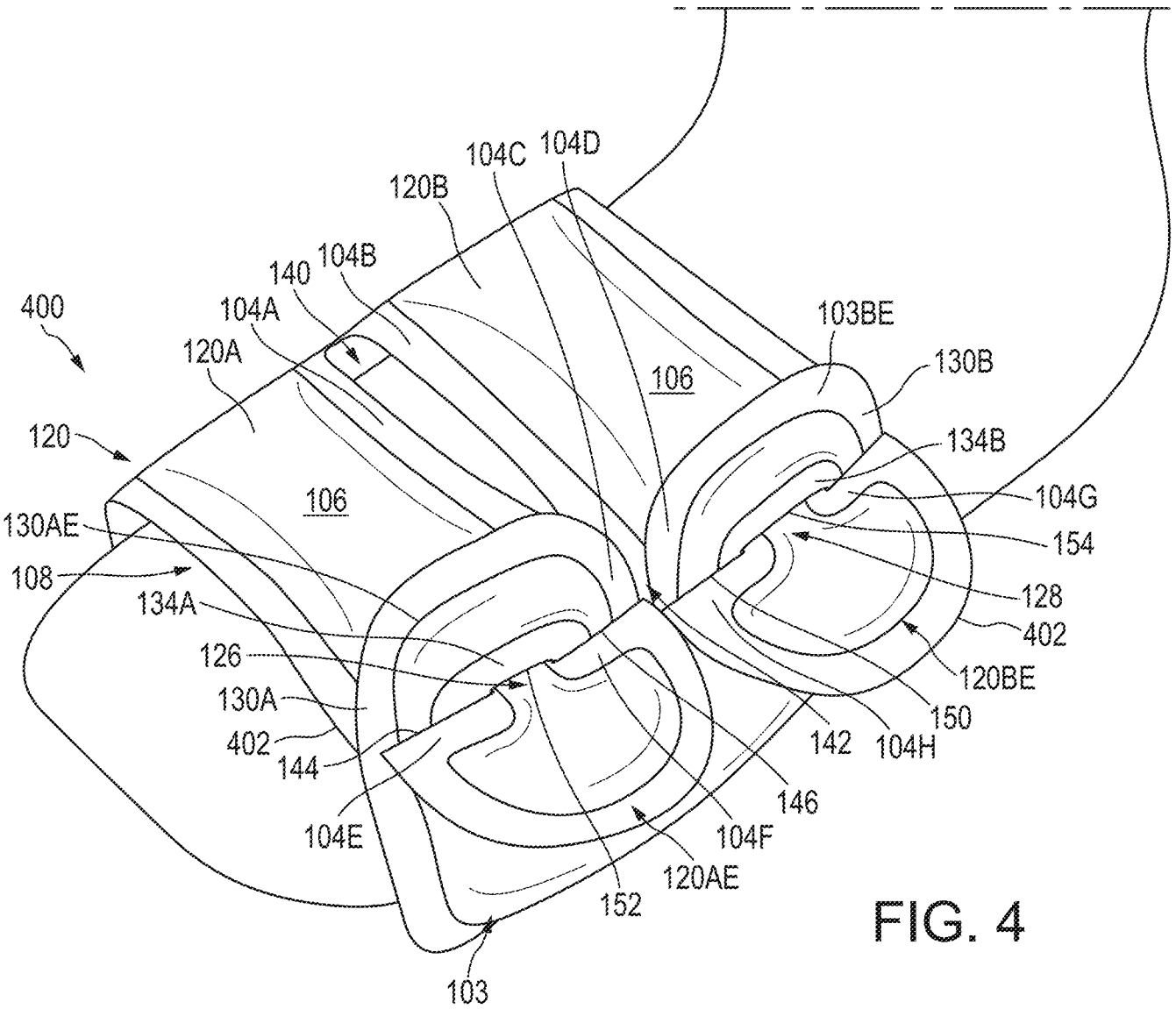
FIG. 4 illustrates another example bladder component in accordance with some examples of this technology that includes an additional support layer (e.g., a fabric layer).

FIG. 4 illustrates another example bladder component 400 in accordance with aspects of this technology. Where the same reference numbers are used in FIG. 4 as used in FIGS. 1-3B, the same or similar parts are being referenced, and much of the overlapping description may be omitted. The bladder portion of the bladder component 400 of FIG. 4 may be the same (e.g., same shape, same features, same construction) as the bladder component 100 of FIGS. 1-3B, including all of the options and/or alternatives described above for the various parts. One difference in the bladder component 400 of FIG. 4 as compared to those of FIGS. 1-3B relates to a support layer 402 (e.g., a fabric layer) engaged with at least one of the thermoplastic elastomer sheets (e.g., with the exterior surface 102AX of the first thermoplastic elastomer sheet in this illustrated example). The support layer 402 also is shown in broken lines in FIG. 1B. The support layer 402 (e.g., a fabric layer) may be engaged with the thermoplastic elastomer material (e.g., 102A) of a bladder component (e.g., with a bladder component 100 of the types described above) by adhesives, by adhesive free bonding, by welding techniques, etc., including in any of the ways described in U.S. Provisional Patent Appln. No. 63/277,916 filed Nov. 10, 2021 and/or described in U.S. Provisional Patent Appln. No. 63/277,932 filed Nov. 10, 2021. Each of U.S. Provisional Patent Appln. No. 63/277,916 and U.S. Provisional Patent Appln. No. 63/277,932 is entirely incorporated herein by reference. The support layer 402 (e.g., a fabric layer) may be arranged to be in direct contact with the wearer's foot, e.g., as shown in FIG. 4. The support layer 402 (e.g., a fabric layer) can provide a more comfortable feel, e.g., by enhancing breathability, reducing perspiration, wicking moisture, etc., and/or can provide additional design, color, and/or aesthetic options. The bladder component 400 may be engaged with a sole component (e.g., 250, 252) and/or incorporated into an article of footwear 200 in any of the manners described above (e.g., by adhesives, by one or more mechanical connectors, by non-adhesive bonding techniques, by sewing, etc.).

The support layer(s) 402 (e.g., a fabric layer), when present, may extend to cover any desired portion of the exterior surface (e.g., 102AX and/or 102BX) of one or both thermoplastic elastomer sheets 102A, 102B. As some more specific examples, the support layer 402 (e.g., a fabric layer, formed from one or more parts) may be sized, shaped, and arranged to cover at least 75% of the exterior surface 102AX of the first thermoplastic elastomer sheet 102A in any one or more of the foot support chamber portion 110, the first side chamber portion 120, the second side chamber portion 130, and/or the overall first thermoplastic elastomer sheet 102A. In some examples, the support layer 402 (e.g., a fabric layer)

may be sized, shaped, and arranged to cover from 75% to 100%, from 80% to 100%, from 85% to 100%, from 90% to 100%, or even from 95% to 100% of the exterior surface 102AX of the first thermoplastic elastomer sheet 102A in any one or more of the foot support chamber portion 110, the first side chamber portion 120, the second side chamber portion 130 and/or the overall first thermoplastic elastomer sheet 102A. Additionally or alternatively, the support layer 402 (e.g., a fabric layer, formed from one or more parts) may be sized, shaped, and arranged to cover at least 75% of the exterior surface 102BX of the second thermoplastic elastomer sheet 102B in any one or more of the foot support chamber portion 110, the first side chamber portion 120, the second side chamber portion 130, and/or the overall second thermoplastic elastomer sheet 102B. In some examples, the support layer 402 (e.g., a fabric layer) may be sized, shaped, and arranged to cover from 75% to 100%, from 80% to 100%, from 85% to 100%, from 90% to 100%, or even from 95% to 100% of the exterior surface 102BX of the second thermoplastic elastomer sheet 102B in any one or more of the foot support chamber portion 110, the first side chamber portion 120, the second side chamber portion 130, and/or the overall second thermoplastic elastomer sheet 102B.

In the examples described above, both the first side bladder chamber portion 120 and the second side bladder chamber portion 130 include an interior bladder chamber 106 filled with fluid (e.g., gas under pressure). Alternatively, if desired, either one of the side bladder chamber portions could be replaced by a side component that does not include a fluid-filled chamber portion. As a more specific example, a first side bladder chamber portion 120 of the types described above could engage a slotted strap or flap that includes openings 152 and/or 154 (or other strap securing structures) but does not include a fluid-filled bladder chamber. As another example, a second side bladder chamber portion 130 of the types described above could engage one or more non-fluid-filled straps (e.g., fabric or plastic straps), e.g., that include one or more free ends 120AE, 120BE and openings 144, 146, 148, 150.

While the figures illustrate the first side chamber portion 120 as including one or more securing straps and second side chamber portion 130 as including one or more strap-engaging members for an article of footwear, as noted above, the side bladder chamber portion(s) 120 and/or 130 may comprise at least portions of one or more footwear upper components, e.g., footwear upper components that are not part of a releasable securing strap or strap-engaging member. Such bladder systems 100 and/or articles of footwear may include first and/or second side bladder chamber portions 120 and/or 130 that are permanently and fixedly engaged to one another and/or to other components in the footwear structure. Such first and/or second side bladder chamber portions 120 and/or 130 (when not present as part of a releasable securing strap system) may form one or more of: (i) at least a portion of a footwear instep upper component (e.g., for supporting and/or protecting the instep region of a wearer's foot), (ii) at least a portion of a forefoot lateral side upper component (e.g., for supporting and/or protecting the forefoot lateral side of a wearer's foot), (iii) at least a portion of a forefoot medial side upper component (e.g., for supporting and/or protecting the forefoot medial side of a wearer's foot), (iv) at least a portion of a midfoot lateral side upper component (e.g., for supporting and/or protecting the midfoot lateral side of a wearer's foot), (v) at least a portion of a midfoot medial side upper component (e.g., for supporting and/or protecting the midfoot medial side of a wearer's foot, (vi) at least a portion of a heel lateral side upper component (e.g., for supporting and/or protecting the heel lateral side of a wearer's foot), and/or (vii) at least a portion of a heel medial side upper component (e.g., for supporting and/or protecting the heel medial side of a wearer's foot.

Additionally or alternatively, in at least some examples of this technology, the foot support chamber portion 110 may comprise at least a portion of a strobel component for an article of footwear in which the bladder system 100 is incorporated. For example, bottom edges of one or more footwear upper components may be engaged with the outer perimeter bond 104 and/or the support layer 402 such that the foot support chamber portion 110 (at least in part) closes off the bottom of the footwear upper. The foot support bladder chamber portion 110 and bladder system 100 may be engaged with a sole structure (e.g., a footwear midsole and/or outsole component), e.g., by one or more of adhesives, sewing, fusing techniques, mechanical connectors, etc. Also, while the illustrated examples show a sandal, slide, or flip-flop type article of footwear, aspects of this technology may be used in any desired type of footwear structure, including athletic footwear, casual footwear, etc.

While FIGS. 1-4 illustrate various different bladder sizes, shapes, and specific configurations, many variations in bladder sizes, shapes, and/or configurations are possible without departing from this technology. The specifically illustrated bladders could be varied widely in size, shape, and/or configuration while still providing the desired functions and/or properties described above.

III. CONCLUSION

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap, wherein the first side chamber portion extends outward from a first side of the foot support chamber portion and is in fluid communication with the foot support chamber portion, and (iii) a second side chamber portion forming at least part of a first strap-engaging member, wherein the second side chamber portion extends outward from a second side of the foot support chamber portion and is in fluid communication with the foot support chamber portion, wherein the second side of the foot support chamber portion is opposite the first side of the foot support chamber portion, and wherein the first strap-engaging member is configured to releasably hold the first securing strap.

Clause 2. The bladder component according to clause 1, wherein the outer perimeter bond is shaped such that: (i) the first side chamber portion further includes a second securing strap, and (ii) the second side chamber portion forms a second strap-engaging member, wherein the second strap-engaging member is configured to releasably hold the second securing strap.

Clause 3. The bladder component according to clause 2, wherein the first side chamber portion includes a first connecting portion located adjacent the first side of the foot support chamber portion, wherein the first securing strap extends from the first connecting portion to a first strap free end, and wherein the second securing strap extends from the first connecting portion to a second strap free end.

Clause 4. The bladder component according to clause 3, wherein:

at the first strap free end, the outer perimeter bond includes a first inwardly extending bond segment, wherein a first opening extends through the outer perimeter bond at the first inwardly extending bond segment;

at the second strap free end, the outer perimeter bond includes a second inwardly extending bond segment, wherein a second opening extends through the outer perimeter bond at the second inwardly extending bond segment;

the first strap-engaging member includes a first interior bond between the first thermoplastic elastomer sheet and the second thermoplastic elastomer sheet, wherein a third opening extends through the first interior bond, and wherein when the first securing strap is in a secured state, the first strap free end extends through the third opening formed in the first interior bond; and the second strap-engaging member includes a second interior bond between the first thermoplastic elastomer sheet and the second thermoplastic elastomer sheet, wherein a fourth opening extends through the second interior bond, and wherein when the second securing strap is in a secured state, the second strap free end extends through the fourth opening formed in the second interior bond.

Clause 5. The bladder component according to clause 3, wherein:

at the first strap free end, the outer perimeter bond includes: (a) a first inwardly extending bond segment, (b) a first opening extending through the outer perimeter bond at the first inwardly extending bond segment, (c) a second inwardly extending bond segment, and (d) a second opening extending through the outer perimeter bond at the second inwardly extending bond segment, wherein the first inwardly extending bond segment and the first opening extend toward the second inwardly extending bond segment and the second opening, and wherein a first fluid passage is defined within the first securing strap between the first inwardly extending bond segment and the second inwardly extending bond segment;

at the second strap free end, the outer perimeter bond includes: (a) a third inwardly extending bond segment, (b) a third opening extending through the outer perimeter bond at the third inwardly extending bond segment, (c) a fourth inwardly extending bond segment, and (d) a fourth opening extending through the outer perimeter bond at the fourth inwardly extending bond segment, wherein the third inwardly extending bond segment and the third opening extend toward the fourth inwardly extending bond segment and the fourth opening, and wherein a second fluid passage is defined within the second securing strap between the third inwardly extending bond segment and the fourth inwardly extending bond segment;

the first strap-engaging member includes a first interior bond between the first thermoplastic elastomer sheet and the second thermoplastic elastomer sheet, wherein a fifth opening extends through the first interior bond, and wherein when the first securing strap is in a secured state, the first fluid passage extends through the fifth opening formed in the first interior bond; and the second strap-engaging member includes a second interior bond between the first thermoplastic elastomer sheet and the second thermoplastic elastomer sheet, wherein a sixth opening extends through the second interior bond, and wherein when the second securing strap is in a secured state, the second fluid passage extends through the sixth opening formed in the second interior bond.

Clause 6. The bladder component according to any one of clauses 2 to 5, wherein the second side chamber portion includes a second connecting portion located adjacent the second side of the foot support chamber portion, and wherein each of the first strap-engaging member and the second strap-engaging member is located at a free end of the second side chamber portion located opposite from the second connecting portion.

Clause 7. The bladder component according to any one of clauses 2 to 5, wherein the second side chamber portion includes a second connecting portion located adjacent the second side of the foot support chamber portion, and wherein the first strap-engaging member and the second strap-engaging member are separated from one another by at least one segment of the outer perimeter bond.

Clause 8. The bladder component according to any one of clauses 2 to 5, wherein the second side chamber portion includes a second connecting portion located adjacent the second side of the foot support chamber portion, and wherein the first strap-engaging member and the second strap-engaging member are separated from one another by two segments of the outer perimeter bond.

Clause 9. The bladder component according to any one of clauses 2 to 8, wherein the outer perimeter bond includes a first strap defining segment and a second strap defining segment, wherein an opening separates the first strap defining segment from the second strap defining segment and separates the first securing strap from the second securing strap.

Clause 10. The bladder component according to clause 1, wherein the first side chamber portion includes a first connecting portion located adjacent the first side of the foot support chamber portion, wherein the first securing strap extends from the first connecting portion to a first strap free end.

Clause 11. The bladder component according to clause 10, wherein:

at the first strap free end, the outer perimeter bond includes a first inwardly extending bond segment, wherein a first opening extends through the outer perimeter bond at the first inwardly extending bond segment; and the first strap-engaging member includes a first interior bond between the first thermoplastic elastomer sheet and the second thermoplastic elastomer sheet, wherein a second opening extends through the first interior bond, and wherein when the first securing strap is in a secured state, the first strap free end extends through the second opening formed in the first interior bond.

Clause 12. The bladder component according to clause 10, wherein:

at the first strap free end, the outer perimeter bond includes: (a) a first inwardly extending bond segment, (b) a first opening extending through the outer perimeter bond at the first inwardly extending bond segment, (c) a second inwardly extending bond segment, and (d) a second opening extending through the outer perimeter bond at the second inwardly extending bond segment, wherein the first inwardly extending bond segment and the first opening extend toward the second inwardly extending bond segment and the second opening, and wherein a first fluid passage is defined within the first securing strap between the first inwardly extending bond segment and the second inwardly extending bond segment; and the first strap-engaging member includes a first interior bond between the first thermoplastic elastomer sheet and the second thermoplastic elastomer sheet, wherein a third opening extends through the first interior bond, and wherein when the first securing strap is in a secured state, the first fluid passage extends through the third opening formed in the first interior bond.

Clause 13. The bladder component according to any one of clauses 1 to 12, wherein the outer perimeter bond includes: (i) a first bond segment separating the foot support chamber portion and the first side chamber portion at the first side of the foot support chamber portion, and (ii) a second bond segment separating the foot support chamber portion and the first side chamber portion at the first side of the foot support chamber portion, wherein a first side fluid passageway extends between the first bond segment and the second bond segment to place the first side chamber portion in fluid communication with the foot support chamber portion.

Clause 14. The bladder component according to any one of clauses 1 to 13, wherein the outer perimeter bond includes: (i) a third bond segment separating the foot support chamber portion and the second side chamber portion at the second side of the foot support chamber portion, and (ii) a fourth bond segment separating the foot support chamber portion and the second side chamber portion at the second side of the foot support chamber portion, wherein a second side fluid passageway extends between the third bond segment and the fourth bond segment to place the second side chamber portion in fluid communication with the foot support chamber portion.

Clause 15. The bladder component according to any one of clauses 1 to 12, wherein the outer perimeter bond includes a first bond segment separating the foot support chamber portion and the first side chamber portion at the first side of the foot support chamber portion.

Clause 16. The bladder component according to any one of clauses 1 to 12 or 15, wherein the outer perimeter bond includes a second bond segment separating the foot support chamber portion and the second side chamber portion at the second side of the foot support chamber portion.

Clause 17. The bladder component according to any one of clauses 1 to 16, wherein the outer perimeter bond further defines an inflation port.

Clause 18. The bladder component according to clause 17, wherein the inflation port opens into the foot support chamber portion.

Clause 19. The bladder component according to any one of clauses 1 to 18, further comprising a fabric layer engaged with the first thermoplastic elastomer sheet.

Clause 20. The bladder component according to any one of clauses 1 to 12 or 15 to 19, wherein the foot support chamber portion includes an outer sealed edge as part of the outer perimeter bond, wherein the outer sealed edge includes a first side passageway providing fluid communication with the first side chamber portion and a second side passageway providing fluid communication with the second side chamber portion, and wherein the outer sealed edge extends around at least 90% of an outer periphery of foot support chamber portion.

Clause 21. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, and (ii) a first side chamber portion forming at least part of a first securing strap, wherein the first side chamber portion extends outward from a first side of the foot support chamber portion and is in fluid communication with the foot support chamber portion.

Clause 22. The bladder component according to clause 21, wherein the outer perimeter bond is shaped such that the first side chamber portion further includes a second securing strap.

Clause 23. The bladder component according to clause 22, wherein the first side chamber portion includes a first connecting portion located adjacent the first side of the foot support chamber portion, wherein the first securing strap extends from the first connecting portion to a first strap free end, and wherein the second securing strap extends from the first connecting portion to a second strap free end.

Clause 24. The bladder component according to clause 23, wherein:

at the first strap free end, the outer perimeter bond includes a first inwardly extending bond segment, wherein a first opening extends through the outer perimeter bond at the first inwardly extending bond segment; and at the second strap free end, the outer perimeter bond includes a second inwardly extending bond segment, wherein a second opening extends through the outer perimeter bond at the second inwardly extending bond segment.

Clause 25. The bladder component according to clause 23, wherein:

at the first strap free end, the outer perimeter bond includes: (a) a first inwardly extending bond segment, (b) a first opening extending through the outer perimeter bond at the first inwardly extending bond segment, (c) a second inwardly extending bond segment, and (d) a second opening extending through the outer perimeter bond at the second inwardly extending bond segment, wherein the first inwardly extending bond segment and the first opening extend toward the second inwardly extending bond segment and the second opening, and wherein a first fluid passage is defined within the first securing strap between the first inwardly extending bond segment and the second inwardly extending bond segment; and at the second strap free end, the outer perimeter bond includes: (a) a third inwardly extending bond segment, (b) a third opening extending through the outer perimeter bond at the third inwardly extending bond segment, (c) a fourth inwardly extending bond segment, and (d) a fourth opening extending through the outer perimeter bond at the fourth inwardly extending bond segment, wherein the third inwardly extending bond segment and the third opening extend toward the fourth inwardly extending bond segment and the fourth opening, and wherein a second fluid passage is defined within the second securing strap between the third inwardly extending bond segment and the fourth inwardly extending bond segment.

Clause 26. The bladder component according to any one of clauses 22 to 25, wherein the outer perimeter bond includes a first strap defining segment and a second strap defining segment, wherein an opening separates the first strap defining segment from the second strap defining segment and separates the first securing strap from the second securing strap.

Clause 27. The bladder component according to clause 21, wherein the first side chamber portion includes a first connecting portion located adjacent the first side of the foot support chamber portion, wherein the first securing strap extends from the first connecting portion to a first strap free end.

Clause 28. The bladder component according to clause 27, wherein at the first strap free end, the outer perimeter bond includes a first inwardly extending bond segment, wherein a first opening extends through the outer perimeter bond at the first inwardly extending bond segment.

Clause 29. The bladder component according to clause 27, wherein at the first strap free end, the outer perimeter bond includes: (a) a first inwardly extending bond segment, (b) a first opening extending through the outer perimeter bond at the first inwardly extending bond segment, (c) a second inwardly extending bond segment, and (d) a second opening extending through the outer perimeter bond at the second inwardly extending bond segment, wherein the first inwardly extending bond segment and the first opening extend toward the second inwardly extending bond segment and the second opening, and wherein a first fluid passage is defined within the first securing strap between the first inwardly extending bond segment and the second inwardly extending bond segment.

Clause 30. The bladder component according to any one of clauses 21 to 29, wherein the outer perimeter bond includes: (i) a first bond segment separating the foot support chamber portion and the first side chamber portion at the first side of the foot support chamber portion, and (ii) a second bond segment separating the foot support chamber portion and the first side chamber portion at the first side of the foot support chamber portion, wherein a first side fluid passageway extends between the first bond segment and the second bond segment to place the first side chamber portion in fluid communication with the foot support chamber portion.

Clause 31. The bladder component according to any one of clauses 21 to 29, wherein the outer perimeter bond includes a first bond segment separating the foot support chamber portion and the first side chamber portion at the first side of the foot support chamber portion.

Clause 32. The bladder component according to any one of clauses 21 to 31, wherein the outer perimeter bond further defines an inflation port.

Clause 33. The bladder component according to clause 32, wherein the inflation port opens into the foot support chamber portion.

Clause 34. The bladder component according to any one of clauses 21 to 33, further comprising a fabric layer engaged with the first thermoplastic elastomer sheet.

Clause 35. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, wherein the foot support chamber portion includes a first side and a second side, and (ii) a second side chamber portion forming at least part of a first strap-engaging member, wherein the second side chamber portion extends outward from the second side of the foot support chamber portion and is in fluid communication with the foot support chamber portion, wherein the second side of the foot support chamber portion is opposite the first side of the foot support chamber portion, and wherein the first strap-engaging member is configured to releasably hold a first securing strap.

Clause 36. The bladder component according to clause 35, wherein the outer perimeter bond is shaped such that the second side chamber portion forms a second strap-engaging member, wherein the second strap-engaging member is configured to releasably hold a second securing strap.

Clause 37. The bladder component according to clause 36, wherein:

the first strap-engaging member includes a first interior bond between the first thermoplastic elastomer sheet and the second thermoplastic elastomer sheet, wherein a first opening extends through the first interior bond, and wherein when the first securing strap is in a secured state, a portion of the first securing strap extends through the first opening formed in the first interior bond; and the second strap-engaging member includes a second interior bond between the first thermoplastic elastomer sheet and the second thermoplastic elastomer sheet, wherein a second opening extends through the second interior bond, and wherein when the second securing strap is in a secured state, a portion of the second securing strap extends through the second opening formed in the second interior bond.

Clause 38. The bladder component according to any one of clauses 36 or 37, wherein the second side chamber portion includes a connecting portion located adjacent the second side of the foot support chamber portion, and wherein each of the first strap-engaging member and the second strap-engaging member is located at a free end of the second side chamber portion.

Clause 39. The bladder component according to any one of clauses 36 or 37, wherein the second side chamber portion includes a connecting portion located adjacent the second side of the foot support chamber portion, and wherein the first strap-engaging member and the second strap-engaging member are separated from one another by at least one segment of the outer perimeter bond.

Clause 40. The bladder component according to any one of clauses 36 or 37, wherein the second side chamber portion includes a second connecting portion located adjacent the second side of the foot support chamber portion, and wherein the first strap-engaging member and the second strap-engaging member are separated from one another by two segments of the outer perimeter bond.

Clause 41. The bladder component according to clause 35, wherein the first strap-engaging member includes a first interior bond between the first thermoplastic elastomer sheet and the second thermoplastic elastomer sheet, wherein an opening extends through the first interior bond, and wherein when the first securing strap is in a secured state, the first securing strap extends through the opening formed in the first interior bond.

Clause 42. The bladder component according to any one of clauses 35 to 41, wherein the outer perimeter bond includes: (i) a first bond segment separating the foot support chamber portion and the second side chamber portion at the second side of the foot support chamber portion, and (ii) a second bond segment separating the foot support chamber portion and the second side chamber portion at the second side of the foot support chamber portion, wherein a second side fluid passageway extends between the first bond segment and the second bond segment to place the second side chamber portion in fluid communication with the foot support chamber portion.

Clause 43. The bladder component according to any one of clauses 35 to 42, wherein the outer perimeter bond includes a first bond segment separating the foot support chamber portion and the second side chamber portion at the second side of the foot support chamber portion.

Clause 44. The bladder component according to any one of clauses 35 to 43, wherein the outer perimeter bond further defines an inflation port.

Clause 45. The bladder component according to clause 44, wherein the inflation port opens into the foot support chamber portion.

Clause 46. The bladder component according to any one of clauses 35 to 45, further comprising a fabric layer engaged with the first thermoplastic elastomer sheet.

Clause 47. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, wherein the foot support chamber portion includes a first side and a second side located opposite the first side, and (ii) a first side chamber portion forming at least part of a first footwear upper component, wherein the first side chamber portion extends outward from the first side of the foot support chamber portion and is in fluid communication with the foot support chamber portion.

Clause 48. The bladder component according to clause 47, wherein the outer perimeter bond further is shaped such that the interior chamber forms a second side chamber portion forming at least part of the first footwear upper component and/or a second footwear upper component, wherein the second side chamber portion extends outward from the second side of the foot support chamber portion and is in fluid communication with the foot support chamber portion.

Clause 49. The bladder component according to clause 48, wherein the first side chamber portion and the second side chamber portion are releasably secured to one another in a hardware free manner.

Clause 50. The bladder component according to clause 48, wherein the first side chamber portion and the second side chamber portion are releasably secured to one another.

Clause 51. The bladder component according to any one of clauses 47 to 50, further comprising a fabric layer engaged with the first thermoplastic elastomer sheet.

Clause 52. A sole structure for an article of footwear, comprising:

a sole component; and a bladder component according to any one of clauses 1 to 51 engaged with the sole component.

Clause 53. The sole structure according to clause 52, wherein the foot support chamber portion is engaged with the sole component.

Clause 54. The sole structure according to clause 52, wherein the foot support chamber portion is engaged with a plantar support surface of the sole component.

Clause 55. The sole structure according to clause 54, wherein the plantar support surface of the sole component defines a recess into which the bladder component is received.

Clause 56. The sole structure according to any one of clauses 52 to 55, wherein the sole component comprises a foam component.

Clause 57. An article of footwear, comprising:

a sole component; and a bladder component according to any one of clauses 1 to 51 engaged with the sole component.

Clause 58. The article of footwear according to clause 57, wherein the foot support chamber portion is engaged with the sole component.

Clause 59. The article of footwear according to clause 57, wherein the foot support chamber portion is engaged with a plantar support surface of the sole component.

Clause 60. The article of footwear according to clause 59, wherein the plantar support surface of the sole component defines a recess into which the bladder component is received.

Clause 61. The article of footwear according to any one of clauses 57 to 60, wherein the sole component comprises a foam component.

Clause 62. The article of footwear according to any one of clauses 57 to 61, wherein the sole component includes an outsole as a ground-contacting surface.

Clause 63. The article of footwear according to any one of clauses 57 to 62, wherein the first side chamber portion and/or the second side chamber portion comprise at least portions of an upper for the article of footwear.

Clause 64. The article of footwear according to any one of clauses 57 to 62, wherein the first securing strap and/or the first strap-engaging member comprise at least portions of an upper for the article of footwear.

Clause 65. An article of footwear, consisting essentially of:

a sole member including one or more of a midsole and an outsole; and a bladder component according to any one of clauses 1 to 51 engaged with the sole member.

Clause 66. The article of footwear according to clause 65, wherein the foot support chamber portion is engaged with the sole member.

Clause 67. The article of footwear according to clause 65, wherein the foot support chamber portion is engaged with a plantar support surface of the sole member.

Clause 68. The article of footwear according to clause 67, wherein the plantar support surface of the sole member defines a recess into which the bladder component is received.

Clause 69. The article of footwear according to any one of clauses 65 to 68, wherein the sole member includes the midsole, and wherein the midsole includes a foam component.

Clause 70. The article of footwear according to any one of clauses 65 to 69, wherein the sole member includes the outsole as a ground-contacting surface.

Clause 71. The article of footwear according to any one of clauses 65 to 70, wherein the first side chamber portion and/or the second side chamber portion constitute an upper for the article of footwear.

Clause 72. The article of footwear according to any one of clauses 65 to 71, wherein all footwear securing components of the article of footwear are integrally formed as part of the first side chamber portion and/or the second side chamber portion.

Clause 73. The article of footwear according to any one of clauses 57 to 72, wherein the article of footwear constitutes a sandal, slide, or flip-flop.

What is claimed is:

1. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap, wherein the first side chamber portion extends outward from a first side of the foot support chamber portion and is in fluid communication with the foot support chamber portion, and (iii) a second side chamber portion forming at least part of a first strap-engaging member, wherein the second side chamber portion extends outward from a second side of the foot support chamber portion and is in fluid communication with the foot support chamber portion, wherein the second side of the foot support chamber portion is opposite the first side of the foot support chamber portion, and wherein the first strap-engaging member is configured to releasably hold the first securing strap;

wherein the outer perimeter bond is shaped such that: (i) the first side chamber portion further includes a second securing strap, and (ii) the second side chamber portion forms a second strap-engaging member, wherein the second strap-engaging member is configured to releasably hold the second securing strap;

wherein the first side chamber portion includes a first connecting portion located adjacent the first side of the foot support chamber portion, wherein the first securing strap extends from the first connecting portion to a first strap free end, and wherein the second securing strap extends from the first connecting portion to a second strap free end; and wherein:

at the first strap free end, the outer perimeter bond includes a first inwardly extending bond segment, wherein a first opening extends through the outer perimeter bond at the first inwardly extending bond segment;

at the second strap free end, the outer perimeter bond includes a second inwardly extending bond segment, wherein a second opening extends through the outer perimeter bond at the second inwardly extending bond segment;

the first strap-engaging member includes a first interior bond between the first thermoplastic elastomer sheet and the second thermoplastic elastomer sheet, wherein a third opening extends through the first interior bond, and wherein when the first securing strap is in a secured state, the first strap free end extends through the third opening formed in the first interior bond; and the second strap-engaging member includes a second interior bond between the first thermoplastic elastomer sheet and the second thermoplastic elastomer sheet, wherein a fourth opening extends through the second interior bond, and wherein when the second securing strap is in a secured state, the second strap free end extends through the fourth opening formed in the second interior bond.

2. The bladder component according to claim 1, wherein the second side chamber portion includes a second connecting portion located adjacent the second side of the foot support chamber portion, and wherein each of the first strap-engaging member and the second strap-engaging member is located at a free end of the second side chamber portion located opposite from the second connecting portion.

3. The bladder component according to claim 1, wherein the second side chamber portion includes a second connecting portion located adjacent the second side of the foot support chamber portion, and wherein the first strap-engaging member and the second strap-engaging member are separated from one another by at least one segment of the outer perimeter bond.

4. The bladder component according to claim 1, wherein the second side chamber portion includes a second connecting portion located adjacent the second side of the foot support chamber portion, and wherein the first strap-engaging member and the second strap-engaging member are separated from one another by two segments of the outer perimeter bond.

5. The bladder component according to claim 1, wherein the outer perimeter bond includes a first strap defining segment and a second strap defining segment, wherein an opening separates the first strap defining segment from the second strap defining segment and separates the first securing strap from the second securing strap.

6. The bladder component according to of claim 1, wherein the outer perimeter bond includes: (i) a first bond segment separating the foot support chamber portion and the first side chamber portion at the first side of the foot support chamber portion, and (ii) a second bond segment separating the foot support chamber portion and the first side chamber portion at the first side of the foot support chamber portion, wherein a first side fluid passageway extends between the first bond segment and the second bond segment to place the first side chamber portion in fluid communication with the foot support chamber portion.

7. The bladder component according to claim 1, wherein the outer perimeter bond includes: (i) a third bond segment separating the foot support chamber portion and the second side chamber portion at the second side of the foot support chamber portion, and (ii) a fourth bond segment separating the foot support chamber portion and the second side chamber portion at the second side of the foot support chamber portion, wherein a second side fluid passageway extends between the third bond segment and the fourth bond segment to place the second side chamber portion in fluid communication with the foot support chamber portion.

8. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, wherein the foot support chamber portion includes a first side and a second side, and (ii) a second side chamber portion forming at least part of a first strap-engaging member, wherein the second side chamber portion extends outward from the second side of the foot support chamber portion and is in fluid communication with the foot support chamber portion, wherein the second side of the foot support chamber portion is opposite the first side of the foot support chamber portion, and wherein the first strap-engaging member is configured to releasably hold a first securing strap;

wherein the outer perimeter bond is shaped such that the second side chamber portion forms a second strap-engaging member, wherein the second strap-engaging member is configured to releasably hold a second securing strap;

wherein the first strap-engaging member includes a first interior bond between the first thermoplastic elastomer sheet and the second thermoplastic elastomer sheet, wherein a first opening extends through the first interior bond, and wherein when the first securing strap is in a secured state, a portion of the first securing strap extends through the first opening formed in the first interior bond; and wherein the second strap-engaging member includes a second interior bond between the first thermoplastic elastomer sheet and the second thermoplastic elastomer sheet, wherein a second opening extends through the second interior bond, and wherein when the second securing strap is in a secured state, a portion of the second securing strap extends through the second opening formed in the second interior bond.

9. A bladder component for an article of footwear, comprising:

a first thermoplastic elastomer sheet; and a second thermoplastic elastomer sheet joined to the first thermoplastic elastomer sheet by an outer perimeter bond, wherein an interior chamber is defined between the first thermoplastic elastomer sheet and the second thermoplastic elastomer sheet and inside of the outer perimeter bond, and wherein the outer perimeter bond is shaped such that the interior chamber forms:

(i) a foot support chamber portion for supporting at least a portion of a plantar surface of a wearer's foot, (ii) a first side chamber portion forming at least part of a first securing strap, wherein the first side chamber portion extends outward from a first side of the foot support chamber portion and is in fluid communication with the foot support chamber portion, and (iii) a second side chamber portion forming at least part of a first strap-engaging member, wherein the second side chamber portion extends outward from a second side of the foot support chamber portion and is in fluid communication with the foot support chamber portion, wherein the second side of the foot support chamber portion is opposite the first side of the foot support chamber portion, and wherein the first strap-engaging member is configured to releasably hold the first securing strap wherein the first side chamber portion includes a first connecting portion located adjacent the first side of the foot support chamber portion, wherein the first securing strap extends from the first connecting portion to a first strap free end;

wherein at the first strap free end, the outer perimeter bond includes a first inwardly extending bond segment, wherein a first opening extends through the outer perimeter bond at the first inwardly extending bond segment; and wherein the first strap-engaging member includes a first interior bond between the first thermoplastic elastomer sheet and the second thermoplastic elastomer sheet, wherein a second opening extends through the first interior bond, and wherein when the first securing strap is in a secured state, the first strap free end extends through the second opening formed in the first interior bond.

10. The bladder component according to claim 9, wherein:

at the first strap free end, the outer perimeter bond includes: (a) the first inwardly extending bond segment, (b) the first opening extending through the outer perimeter bond at the first inwardly extending bond segment, (c) a second inwardly extending bond segment, and (d) a second opening extending through the outer perimeter bond at the second inwardly extending bond segment, wherein the first inwardly extending bond segment and the first opening extend toward the second inwardly extending bond segment and the second opening extending through the outer perimeter bond at the second inwardly extending bond segment, and wherein a first fluid passage is defined within the first securing strap between the first inwardly extending bond segment and the second inwardly extending bond segment; and the first strap-engaging member includes the first interior bond between the first thermoplastic elastomer sheet and the second thermoplastic elastomer sheet, wherein a third opening extends through the first interior bond, and wherein when the first securing strap is in a secured state, the first fluid passage extends through the third opening formed in the first interior bond.

* * * * *